United States Patent [19]

Shaw

[11] 4,268,380

[45] May 19, 1981

[54] FROTH FLOTATION PROCESS

[75] Inventor: Douglas R. Shaw, Tucson, Ariz.

[73] Assignee: Pennwalt Corporation, Philadelphia, Pa.

[21] Appl. No.: 62,092

[22] Filed: Jul. 30, 1979

Related U.S. Application Data

[63] Continuation-in-part of Ser. No. 934,132, Aug. 15, 1978, abandoned.

[51] Int. Cl.[3] ..... B03D 1/06

[52] U.S. Cl. ..... 209/167

[58] Field of Search ..... 209/166, 167

[56] References Cited

U.S. PATENT DOCUMENTS

| | | | |
|---|---|---|---|
| 1,261,810 | 4/1918 | Hebbard | 209/167 |
| 1,839,155 | 12/1931 | Lubs | 209/166 |
| 1,904,460 | 4/1933 | Moses | 209/166 |
| 2,385,527 | 9/1945 | Mensfee | 209/166 |
| 2,559,104 | 7/1951 | Arbiter | 209/167 X |
| 2,811,255 | 10/1957 | Nokes | 209/167 |
| 2,834,430 | 5/1958 | Johnson | 209/166 |
| 2,957,576 | 10/1960 | Henderson | 209/167 |
| 3,137,649 | 6/1964 | De Benedictis | 209/167 X |
| 3,919,079 | 11/1975 | Weston | 209/166 |
| 4,211,644 | 7/1980 | Wiechers | 209/166 |

FOREIGN PATENT DOCUMENTS

| | | | |
|---|---|---|---|
| 1011183 | 4/1952 | France | 209/167 |
| 358460 | 4/1930 | United Kingdom | 209/167 |

OTHER PUBLICATIONS

Froth Flot, 50 Anniv. vol., Aimme, 1962, pp. 394, 395.

*Primary Examiner*—Robert Halper
*Attorney, Agent, or Firm*—Keil & Witherspoon

[57] ABSTRACT

An improvement in the froth flotation separation of metallic sulfide mineral ores, particularly those ores bearing copper and molybdenum, in which a mercaptan collector is used in an earlier primary flotation stage, the improvement comprising the addition of activated carbon to achieve deactivation of the mercaptan collector prior to the component mineral separation stage, thereby providing enhanced separation of the minerals.

7 Claims, 2 Drawing Figures

FROTH FLOTATION PROCESS

CROSS REFERENCE TO RELATED APPLICATION

This application is a continuation in part of copending application Ser. No. 934,132 now abandoned filed Aug. 15, 1978.

BACKGROUND OF THE INVENTION

This invention relates to an improvement in a froth flotation process for concentration and separation of metallic sulfide mineral ores. The improved process is directed to separations wherein a mercaptan is utilized as a collector in an earlier flotation stage. The improved method of this invention includes the addition of activated carbon to achieve deactivation of the mercaptan prior to a mineral separation stage and to achieve enhanced separation of the metallic elements desired.

Froth flotation is a process commonly employed for separating, collecting, and, hence, concentrating valuable minerals, particularly sulfide and oxide ores, from the gangue minerals associated with these minerals in their ores. The usual steps are as follows:

(a) The ore is crushed and subjected to wet grinding to provide a pulp wherein the ore particles are typically reduced to minus 48 mesh and with about 50% of the particles being in the minus 200 mesh fractions.

(b) The ore pulp is generally diluted with water to approximately 30% solids by weight.

(c) Various conditioning, collecting, and frothing agents are then added to the mineral pulp.

(d) The pulp is then aerated to produce air bubbles that rise to the surface of the pulp and to which the desired mineral particles selectively attach themselves by virtue of the characteristics of the collectors employed, thereby permitting removal of these minerals in a concentrated form.

There are, of course, numerous patents on processes for froth flotation concentration and separation of minerals. One such patent is U.S. Pat. No. 2,559,104 (issued July 3, 1951) to Arbiter et al which relates to a flotation recovery method for molybdenite. Arbiter et al teaches a specific system in which a collector is oxidized prior to subsequent separation stages. The problem addressed in the Arbiter et al patent involves reducing excess further and excess collector inthe subsequent cleaning stage. They tend to collect by virtue of the fact that the bulk of the collector and frother are carried forward into the next cleaning stage. In the Arbiter et al patent, reduction of the excess frother is accomplished by the addition of the activated carbon as required.

U.S. application Ser. No. 852,413, filed Nov. 17, 1977 by Adriaan Wiechers, now U.S. Pat. No. 4,211,644 (the specification and claims of which are specifically incorporated herein by reference) teaches an improved process utilizing a mercaptan as a collector, the preferred mercaptan being normal dodecyl mercaptan ("DDM"). As will be seen hereinafter, the use of DDM increases the overall copper recovery from the ore, but at the same time can make separation of the copper from the molybdenite more difficult.

DRAWINGS

FIGS. 1 and 2 are general flowsheets illustrating treatment of ores from two different sources, Ore A in FIG. 1 and Ore B in FIG. 2. In each figure, the flowsheets compare the treatment steps and recovery percentages for a standard plant process of concentration and separation, a process employing DDM concentration and standard separation, and a process employing DDM concentration and the novel separation procedures of the present invention.

SUMMARY OF THE INVENTION

The improved process of this invention relates to the specific separation of metallic sulfide mineral ores comprising copper and molybdenum through flotation where an alkyl mercaptan has been used as a collector in an earlier flotation stage to provide a cleaner concentrate having the mercaptan present. The improvement in the process comprises deactivating the mercaptan, whereby the subsequent separation flotation stage is removed. The deactivation of the mercaptan is achieved by the addition of an effective amount of powdered activated carbon.

From the drawings, it is clear that an improvement in the overall yield of copper can be achieved by employing an alkyl mercaptan collector, 91.5% as compared to 90% in treatment of Ore A, and 89 to 89.7% as compared to 86.6% in treatment of Ore B. Unfortunately, 33.4% of the copper from Ore A and 67.4% of the copper from Ore B are carried into the molybdenum circuit when DDM is employed, as compared to 18.7% and 42.9%, respectively, for the previously employed standard plant procedure. Using the separation procedure of the present invention to deactivate the DDM prior to separation, only 8.2% of the copper in Ore A and 11.0% of the copper in Ore B are carried into the molybdenum circuit, providing a copper concentrate of 91.8% for Ore A and 89% for Ore B as compared to 81.3% and 57.1% for the standard plant process.

More specifically, the improved process is a method for recovery of metal values by froth flotation from metallic sulfide mineral ores comprising copper and molybdenum, including the steps of:

(A) forming an aqueous mineral pulp from the ore:

(B) subjecting the pulp to rougher flotation to provide a scavenger feed and a rougher concentrate:

(C) adding and effective amount of an alkyl mercaptan of the formula $H_nH_{2n+1}SH$ in which n is at least 12 to the primary flotation stages as a collector and subjecting the scavenger feed to flotation to provide a scavenger tailing and a scavenger concentrate;

(D) combining, regrinding, and cleaning the concentrates from the primary flotation stages (B) and (C) to provide a copper molybdenum cleaner concentrate; and then (E) subjecting the cleaner concentrate of step (D) to component mineral stage flotation separation; the improvement which comprises deactivating substantial amount of the mercaptan collector on the mineral of the ore in the cleaner concentrate of step (D) prior to the component mineral stage flotation separation in step (E), said deactivating comprising adding a deactivating effective amount of activated carbon to the cleaner concentrate prior to flotation in step (E); to provide more effective mineral separation.

It is preferred that the activated carbon be added within the range of about 0.25 to about 1.0 pound of activated carbon per ton of initial ore feed and that it be added to the cleaner concentrate for a sufficient time interval prior to step (E) to provide substantial deactivation of the mercaptan prior to commencement of step (E). Such time interval is preferably within the range of about 5 to 30 minutes.

The invention is particularly applicable to copper-molybednum sulfide containing mineral ores and is quite suited to the typical type of Arizona porphyry ores.

DESCRIPTION OF THE PREFERRED EMBODIMENTS

Figure 1:
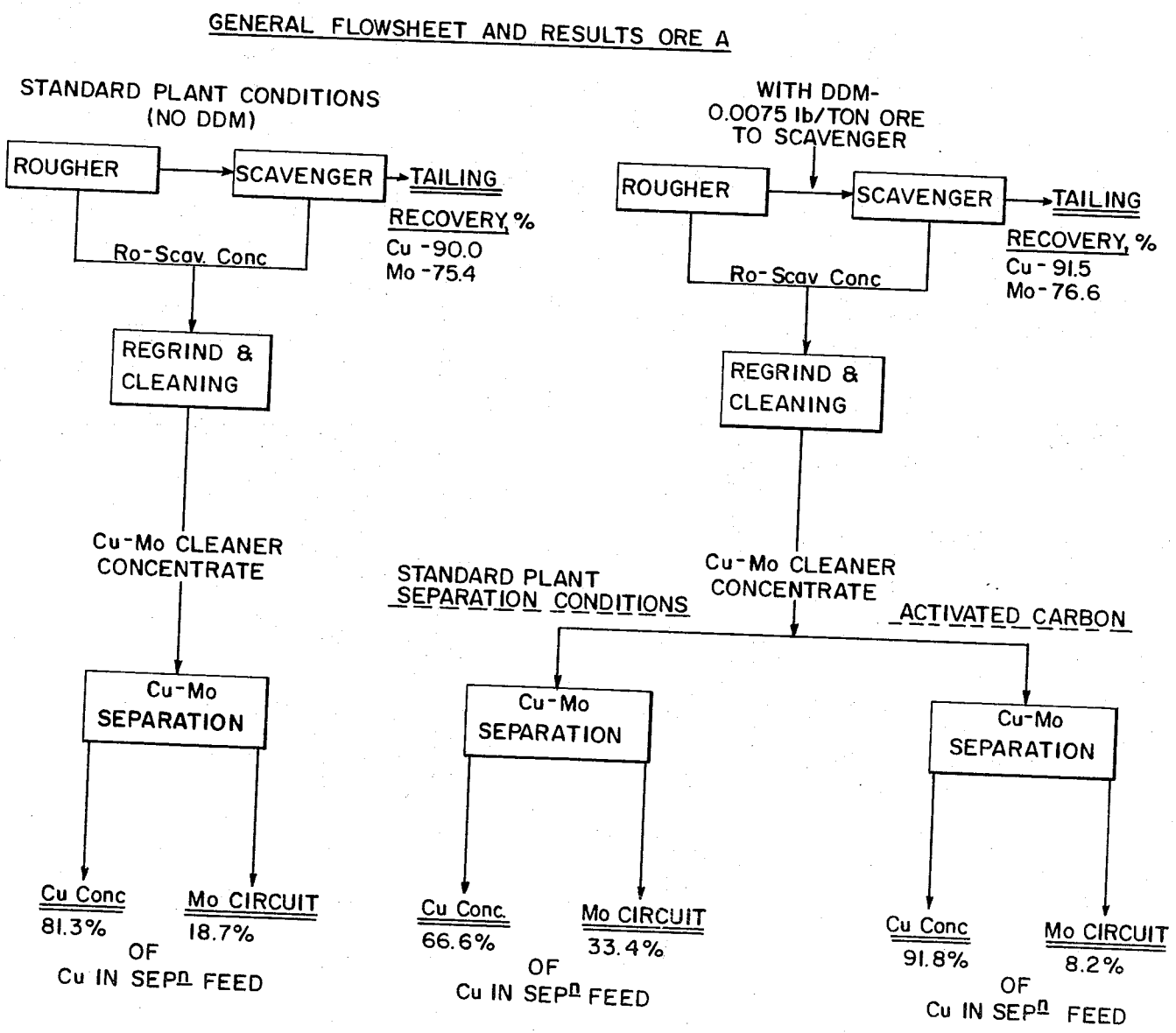

The process of this invention involves subjecting the ore feed to primary grinding and then rougher flotation, including the addition of the appropriate reagents, to provide a feed to the scavenger flotation stage after which the rougher concentrate and the scavenger concentrate are combined, subjected to a regrinding, and then subjected to a number of cleaner flotation stages. Prior to commencement of the scavenger flotation stage, from about 0.005 to about 0.02 pounds per ton ore of a mercaptan (such as normal dodecyl mercaptan, "DDM") is added as an auxiliary collector or promoter to provide increased metals recovery during the primary flotation stages. With certain sulfide minerals such as copper and molybdenum containing ores, the DDM produces undesirable effects in the subsequent separation stage. The process of this invention involves substantially deactivating the DDM prior to the mineral separation stage.

Ore Sample A

A representative ore sample which is the feed to a concentrator is obtained from a typical producing copper-molybdenum concentrator located in Arizona. Copper occurs predominately as chalcopyrite and molybdenum occurs primarily as molybdenite.

Distribution data for the ore sample show that the copper values are approximately equally distributed on all size fractions from 65- to plus 400-mesh with a high distribution of copper (47%) in the minus 400-mesh (37 micrometers). A relatively constant distribution of molybdenum occurs in the coarser size fractions while 67% reports to the minus 400-mesh fraction. The copper and molybdenum minerals are liberated at a relatively coarse mesh of grind.

The assays of the three concentrator cyclone overflow samples utilized in the examples are as follows:

TABLE 1

| | Assay, % | | | |
|---|---|---|---|---|
| | Direct | | Calculated[1] | |
| | Cu | Mo | Cu | Mo |
| Sample 3 | 0.39 | 0.014 | 0.38 | 0.014 |
| Sample 4 | 0.37 | 0.018 | 0.38 | 0.017 |
| Sample 5 | 0.35 | 0.003 | 0.34 | 0.003 |

[1]Average assay as calculated from tests

Standard conditions and reagent balance is shown in Table 2. The reagent balance is substantially identical to that of current conventional plant practice.

TABLE 2

Test Conditions and Reagent Balance

Feed - 4000 grams dry solids cyclone overflow pulp sample

| | Reagents Added, lb/Ton of Ore[1] | | | | Time Minutes | | |
|---|---|---|---|---|---|---|---|
| Stage | CaO | Z-6[3] | AF-238[4] | Shell 1638[5] | Cond | Froth | pH |
| Condition | 1.0 | | | | 1 | | 11.0 |
| Rougher | | 0.01 | 0.005 | 0.03 | 1 | 5 | |
| Scavenger | | | | 0.01 | 1 | 5 | 10.7 |
| Thicken[2] | | | | | | | |
| Regrind | 0.25 | | | | 10 | | |
| 1st cleaner | | | | 0.005 | 1 | 3 | 11.2 |
| 2nd cleaner | 0.10 | | | | 1 | 3 | 11.2 |
| 3rd cleaner | 0.10 | | | | 1 | 2 | 11.2 |
| | $(NH)_4 S_2$ | NaSH | NaCN/ $ZnSO_4$ | | | | |
| Condition 1 | 11.0 | | | | 10 | | |
| Condition 2 | | 25.0 | | | 5 | | |
| Mo rougher | | | | | | 3 | 9.3 |
| Mo 1st cleaner | | 5.0 | | | 5 | 3 | |
| Mo 2nd cleaner | | | 2.0 | | 3 | 2 | 9.0 |

[1]Reagent additions based on lb/ton of ore with exception of $(NH_4)_2$ S, NaSH, and NaCN/ZnSO additions which are based on lb/ton Cu—Mo cleaner concentrate.
[2]Combine rougher and scavenger concentrates. Thicken to approximately 60% solids.
[3]Potassium amyl xanthate
[4]Sodium di secondary butyl dithiophosphate
[5]85% methyl isobutyl carbinol, 15% distillate bottoms The most desirable, readily available activated carbon useful in deactivating the mercaptan collector is of a relatively high pore surface area of about 0.95 ml per gram and is a lignite-based powdered activated carbon. ICI type GFP is particularly useful.

Activated carbon addition is made prior to the sulfidizing reagent addition in the copper-molybdenum separation and about 10 minutes allowed for conditioning.

Summarized in Table 3 are the comparative results illustrating the significant improvement in deactivating the mercaptan collector (DDM) with the addition of activated carbon, while the effect of varying levels of activated carbon is illustrated by the results shown in Table 4.

TABLE 3

Comparison of Effect of General Cu—Mo Separation Processes

| Feed Sample No. | Process | Product | Weight Percent Overall | Assay, % Cu | Assay, % Mo | Distribution, % Overall Cu | Distribution, % Overall Mo |
|---|---|---|---|---|---|---|---|
| 2 | Standard-plant | Mo Ro Conc | 0.20 | 27.9 | 1.48 | 18.7 | 38.8 |

TABLE 3-continued

Comparison of Effect of General Cu—Mo Separation Processes

| Feed Sample No. | Process | Product | Weight Percent Overall | Assay, % Cu | Assay, % Mo | Distribution, % Overall Cu | Distribution, % Overall Mo |
|---|---|---|---|---|---|---|---|
| | (no DDM) | Cu Conc | 0.75 | 26.2 | 0.07 | 66.0 | 7.0 |
| | | Cu + Mo Cl Conc | 0.95 | 26.6 | 0.37 | 84.7 | 45.7 |
| 2 | Standard-plant* | Mo Ro Conc | 0.40 | 25.1 | 0.86 | 33.4 | 43.9 |
| | | Cu Conc | 0.65 | 24.3 | 0.06 | 52.6 | 4.9 |
| | | Cu + Mo Cl Conc | 1.05 | 24.6 | 0.36 | 86.0 | 48.8 |
| 4 | Standard-plant* | Mo Ro Conc | 0.37 | 25.7 | 1.19 | 26.3 | 36.0 |
| | | Cu Conc | 0.74 | 23.8 | 0.04 | 54.2 | 2.3 |
| | | Cu + Mo Cl Conc | 1.11 | 26.2 | 0.40 | 80.5 | 38.3 |
| 3 | Activated carbon* | Mo Ro Conc | 0.20 | 19.5 | 2.23 | 10.0 | 32.9 |
| | (1.0 lb/ton ore) | Cu Conc | 1.06 | 26.0 | 0.05 | 71.3 | 3.9 |
| | | Cu + Mo Cl Conc | 1.26 | 25.0 | 0.40 | 81.3 | 36.8 |

*0.0075 pound of DDM addition per ton of ore feed to the scavenger flotation stage

TABLE 4

Effect of Varying Level of Activated Carbon on Cu—Mo Separation

| Sample No. | Activated Carbon lb/Ton Ore | Product | Weight Percent | Assay, % Cu | Assay, % Mo | Distribution, % Overall Cu | Distribution, % Overall Mo |
|---|---|---|---|---|---|---|---|
| 2 | — | Mo Ro Conc | 0.40 | 25.1 | 0.86 | 33.4 | 43.9 |
| | | Cu Conc | 0.65 | 24.3 | 0.059 | 52.6 | 4.9 |
| | | Cu + Mo Cl Conc | 1.05 | 24.6 | 0.36 | 86.0 | 48.8 |
| 4 | — | Mo Ro Conc | 0.37 | 25.7 | 1.19 | 26.3 | 36.0 |
| | | Cu Conc | 0.74 | 23.8 | 0.035 | 54.2 | 2.3 |
| | | Cu + Mo Cl Conc | 1.11 | 26.2 | 0.40 | 80.5 | 38.3 |
| 4 | 0.25 | Mo Ro Conc | 0.23 | 19.9 | 1.84 | 13.6 | 23.3 |
| | | Cu Conc | 0.88 | 26.0 | 0.041 | 67.6 | 2.0 |
| | | Cu + Mo Cl Conc | 1.11 | 24.7 | 0.41 | 81.2 | 25.3 |
| 3 | 0.50 | Mo Ro Conc | 0.22 | 24.0 | 2.27 | 13.9 | 35.4 |
| | | Cu Conc | 0.94 | 27.0 | 0.060 | 67.1 | 4.0 |
| | | Cu + Mo Cl Conc | 1.15 | 26.7 | 0.48 | 81.0 | 39.4 |
| 3 | 1.0 | Mo Ro Conc | 0.20 | 19.5 | 2.23 | 10.0 | 32.9 |
| | | Cu Conc | 1.06 | 26.0 | 0.050 | 71.3 | 3.9 |
| | | Cu + Mo Cl Conc | 1.26 | 25.0 | 0.40 | 81.3 | 36.8 |
| 4 | 1.35 | Mo Ro Conc | 0.20 | 15.7 | 2.06 | 10.9 | 24.3 |
| | | Cu Conc | 0.86 | 24.4 | 0.14 | 73.3 | 7.1 |
| | | Cu + Mo Cl Conc | 1.06 | 22.8 | 0.50 | 84.2 | 31.4 |
| 4 | 2.0 | Mo Ro Conc | 0.18 | 17.7 | 1.24 | 8.9 | 12.2 |
| | | Cu Conc | 1.07 | 24.2 | 0.31 | 72.7 | 18.2 |
| | | Cu + Mo Cl Conc | 1.25 | 23.2 | 0.44 | 81.6 | 30.4 |

The results indicate that 0.25 to 0.50 pound activated carbon per ton ore is sufficient to reduce the copper displacement in the molybdenum circuit to approximately 13% from approximately 30% without activated carbon. Increasing the activated carbon level to one pound per ton ore result in only a marginal further decrease of copper loss in the molybdenum circuit to about 10%.

Increasing the activated carbon level to greater than one pound per ton of ore does not appear to significantly reduce copper loss to the molybdenum circuit, but it may result in reduced molybdenum recovery to the molybdenum rougher concentrate.

A similar series of experiments were conducted on another typical copper molybdenum ore from a different location in Arizona, designated for convenience, as Ore B. These experiments developed the data for Tables 5 through 9.

Table 5 contains the head assay, Table 6 sets forth the reagent balance, and Table 7 the copper-molybdenum separation reagent balance for the Ore B experiments. Table 8 shows that using activated carbon in the process of the present invention, the copper concentrate contains 92.5% of the copper as compared with 57.1% for the standard plant process and 32.6% for DDM with the standard separation process. Table 9 shows the effect of varying levels of activated carbon, while Table 10 illustrates the wise variety of activated carbons which can be employed.

TABLE 5

Head Assays - Ore B

| | Assay, % Direct Cu | Assay, % Direct Mo | Assay, % Calculated[1] Cu | Assay, % Calculated[1] Mo |
|---|---|---|---|---|
| Sample 1 (HRI No. T-229) | 0.70 | 0.015 | 0.69 | 0.015 |
| Sample 2 (HRI No. T-236) | 0.72 | 0.018 | 0.73 | 0.018 |

[1]Average head assays as calculated from all tests

Additional assays were performed on the Sample 1 head sample. The results are shown below.

| | Assay, % Non-Sulfide Cu[1] | Assay, % Non-Sulfide Mo | Assay, % Fe | Assay, % S (Total) |
|---|---|---|---|---|
| Sample 1 | 0.060 | <0.001 | 3.05 | 1.77 |

[1]Assay confirmed by two analysts

TABLE 6

| Reagent Balance - Ore B | | | | | | | | |
|---|---|---|---|---|---|---|---|---|
| | Reagents Added, lb/Ton Ore | | | | | Time, Minutes | | |
| Stage | CaO | Sm-8[1] | Fuel Oil[2] | Z-11[3] | MIBC[4] | Cond | Froth | pH |
| Primary grind | 1.2 | 0.015 | 0.025 | | 0.05 | — | — | |
| Rougher | | | | | | — | 6 | 10.0 |
| Scavenger | | | | 0.003 | 0.01 | 1 | 6 | 9.7 |
| Thicken[5] | | | | | | — | — | |
| Regrind | 0.2 | | 0.01 | | | — | — | |
| 1st cleaner | | | | | 0.005 | 1 | 4 | 10.0 |
| 2nd cleaner | | | | | | 1 | 3 | 9.2 |
| Stage | Rougher-scavenger | | | | 1st, 2nd cleaner | | | |
| Equipment | Denver D-1, 1000 g cell | | | | Denver D-1, 250 g cell | | | |
| Speed, rpm | 1900 | | | | 1200 | | | |
| Airflow, l/min | ~16 | | | | ~6 | | | |
| % solids | 35 | | | | 15 | | | |

[1]Minerec Sm-8
[2]Fuel oil - 50:50 mixture No. 2 diesel oil/kerosene
[3]Sodium ethyl xanthate
[4]MIBC - 85% methyl iosbutyl carbinol/15% MIBC distillation bottoms
[5]Thickened rougher-scavenger concentrate to approximately 60% solids - decanted (reclaim) water used as makeup in cleaner stages

TABLE 7

| Copper-Molybdenum Separation Reagent Balance | | | | | | | | | | |
|---|---|---|---|---|---|---|---|---|---|---|
| | Reagents Added, lb/Ton Concentrate Feed | | | | | | | Time, Minutes | | |
| Stage | $H_2SO_4$[1] | NaCN ZnO[2] | $H_2O_2$[3] | Na-Ferro CN | K-Ferri CN | NaOCl[4] | MIBC | Cond | Froth | pH |
| Condition 1 | 0.50 | 0.46 | — | — | — | — | — | 20 | — | 8.7–6.7 |
| Condition 2 | 0.20 | — | 3.75 | — | — | — | — | 20 | — | 6.9–6.6 |
| Mo rougher | 0.20 | — | — | 2.0 | — | — | 0.004 | 1 | 4 | 7.0 |
| Mo 1st cleaner | — | — | — | 1.0 | — | — | 0.003 | 1 | 3 | 7.4 |
| Mo 2nd cleaner | — | — | — | — | 0.20 | 1.0 | — | 1 | 3 | 7.6 |
| Mo 3rd cleaner | — | — | — | — | 0.10 | — | 0.02 | 1 | 2 | 7.7 |
| Mo 4th cleaner | — | — | — | — | 0.10 | — | 0.02 | 1 | 2 | 7.8 |
| Mo 5th cleaner | — | — | — | — | 0.10 | — | 0.01 | 1 | 2 | 8.0 |
| Mo 6th cleaner | — | — | — | — | 0.10 | — | 0.01 | 1 | 1½ | 8.1 |
| Condition 1, 2 - pulp density 50% solids | | | | | | | | | | |
| Mo rougher - pulp density 20% solids | | | | | | | | | | |

[1]Addition based on pounds 100% $H_2SO_4$
[2]NaCN/ZnO - 5:1 mixture
[3]30% $H_2O_2$
[4]5% available Cl

TABLE 8

| Comparing Cu/Mo Separation With and Without DDM and Activated Carbon | | | | | | |
|---|---|---|---|---|---|---|
| | | Weight | Assay, % | | Distribution, % | |
| Conditions | Product | % | Cu | Mo | Cu | Mo |
| Standard separation on concentrate without DDM | Mo Cl Conc | 1.68 | 13.3 | 19.6 | 0.8 | 51.5 |
| | Mo Ro Conc | 35.81 | 31.6 | 1.61 | 42.9 | 90.7 |
| | Cu Conc | 64.19 | 23.4 | 0.09 | 57.1 | 9.3 |
| | Head (calc) | 100.00 | 26.3 | 0.64 | 100.0 | 100.0 |
| Standard separation on concentrate with DDM | Mo Cl Conc | 8.74 | 28.9 | 5.80 | 9.5 | 82.8 |
| | Mo Ro Conc | 57.39 | 31.3 | 1.02 | 67.4 | 95.4 |
| | Cu Conc | 42.61 | 20.4 | 0.067 | 32.6 | 4.6 |
| | Head (calc) | 100.00 | 26.7 | 0.61 | 100.0 | 100.0 |
| DDM plus 0.6 lbs/ton ore activated carbon | Mo Cl Conc | 0.91 | 13.8 | 33.7 | 0.5 | 57.8 |
| | Mo Ro Conc | 6.78 | 28.0 | 7.04 | 7.5 | 89.8 |
| | Cu Conc | 93.22 | 25.1 | 0.058 | 92.5 | 10.2 |
| | Head (calc) | 100.00 | 25.3 | 0.53 | 100.0 | 100.0 |

TABLE 9

| Effect of Varying Level of Activated Carbon in Ore B Experiments | | | | | | |
|---|---|---|---|---|---|---|
| | | Weight | Assay, % | | Distribution, % | |
| Conditions | Product | % | Cu | Mo | Cu | Mo |
| Standard, no activated carbon | Mo 3rd Cl conc | 8.74 | 28.9 | 5.80 | 9.5 | 82.8 |
| | Mo Ro conc | 57.38 | 31.3 | 1.02 | 67.4 | 95.4 |
| | Cu conc | 42.61 | 20.4 | 0.067 | 32.6 | 4.6 |
| | Head (calc) | 100.00 | 26.7 | 0.61 | 100.0 | 100.0 |

TABLE 9-continued

Effect of Varying Level of Activated Carbon in Ore B Experiments

| Conditions | Product | Weight % | Assay, % Cu | Assay, % Mo | Distribution, % Cu | Distribution, % Mo |
|---|---|---|---|---|---|---|
| 0.075 lb activated carbon/ton ore (1.37 lb/ton conc) | Mo 3rd Cl conc | 9.23 | 29.2 | 5.30 | 10.8 | 81.3 |
| | Mo Ro conc | 38.21 | 30.8 | 1.46 | 47.5 | 93.8 |
| | Cu conc | 61.79 | 21.0 | 0.059 | 52.5 | 6.2 |
| | Head (calc) | 100.00 | 24.8 | 0.60 | 100.0 | 100.0 |
| 0.15 lb activated carbon/ton ore (2.73 lb/ton conc) | Mo 3rd Cl conc | 3.66 | 26.4 | 12.0 | 3.9 | 76.5 |
| | Mo Ro conc | 23.84 | 30.6 | 2.20 | 29.5 | 91.5 |
| | Cu conc | 76.16 | 22.8 | 0.064 | 70.5 | 8.5 |
| | Head (calc) | 100.00 | 24.7 | 0.57 | 100.0 | 100.0 |
| 0.30 lb activated carbon/ton ore (5.45 lb/ton conc) | Mo 3rd Cl conc | 2.74 | 21.2 | 16.1 | 2.4 | 74.7 |
| | Mo Ro conc | 16.80 | 28.9 | 3.18 | 19.8 | 90.5 |
| | Cu conc | 83.20 | 23.7 | 0.068 | 80.2 | 9.5 |
| | Head (calc) | 100.00 | 24.6 | 0.59 | 100.0 | 100.0 |
| 0.60 lb activated carbon/ton ore (10.91 lb/ton conc) | Mo 3rd Cl conc | 1.77 | 13.7 | 23.5 | 1.0 | 69.8 |
| | Mo Ro conc | 10.73 | 26.6 | 4.98 | 11.6 | 89.5 |
| | Cu conc | 89.27 | 24.4 | 0.070 | 88.4 | 10.5 |
| | Head (calc) | 100.00 | 24.6 | 0.60 | 100.0 | 100.0 |
| 0.90 lb activated carbon/ton ore (16.38 lb/ton conc) | Mo 3rd Cl conc | 2.60 | 18.5 | 15.5 | 2.0 | 75.1 |
| | Mo Ro conc | 11.47 | 26.9 | 4.17 | 12.6 | 89.2 |
| | Cu conc | 88.53 | 24.2 | 0.066 | 87.4 | 10.8 |
| | Head (calc) | 100.00 | 24.5 | 0.54 | 100.0 | 100.0 |
| 1.25 lb activated carbon/ton ore (22.75/ton conc) | Mo 3rd Cl conc | 2.06 | 11.5 | 21.7 | 1.0 | 70.4 |
| | Mo Ro conc | 10.86 | 24.8 | 5.41 | 11.0 | 92.6 |
| | Cu conc | 89.14 | 24.5 | 0.052 | 89.0 | 7.4 |
| | Head (calc) | 100.00 | 24.5 | 0.63 | 100.0 | 100.0 |

TABLE 10

Effect of Type of Activated Carbon (0.6 Pounds Per Ton Ore)

| Activated Carbon | Product | Weight % | Assay, % Cu | Assay, % Mo | Distribution, % Cu | Distribution, % Mo |
|---|---|---|---|---|---|---|
| Darco-GFP | Mo 2nd Cl conc | 0.91 | 13.8 | 33.7 | 0.5 | 57.8 |
| | Mo Ro conc | 6.78 | 28.0 | 7.04 | 7.5 | 89.8 |
| | Cu conc | 93.22 | 25.1 | 0.058 | 92.5 | 10.2 |
| | Head (calc) | 100.00 | 25.3 | 0.53 | 100.0 | 100.0 |
| Darco-FM-1 | Mo 3rd Cl conc | 1.16 | 10.5 | 28.4 | 0.5 | 67.1 |
| | Mo Ro conc | 7.30 | 26.2 | 6.17 | 7.5 | 91.7 |
| | Cu conc | 92.70 | 25.4 | 0.044 | 92.5 | 8.3 |
| | Head (calc) | 100.00 | 25.5 | 0.49 | 100.0 | 100.0 |
| Calgon-PCB | Mo 3rd Cl conc | 2.57 | 18.3 | 17.0 | 1.9 | 78.4 |
| | Mo Ro conc | 13.13 | 28.6 | 3.99 | 15.0 | 93.9 |
| | Cu conc | 86.87 | 24.8 | 0.039 | 85.0 | 6.1 |
| | Head (calc) | 100.00 | 25.3 | 0.56 | 100.0 | 100.0 |
| Union Carbide-LCK | Mo 3rd Cl conc | 2.40 | 14.0 | 18.5 | 1.3 | 74.0 |
| | Mo Ro conc | 11.70 | 27.6 | 4.75 | 12.8 | 92.6 |
| | Cu conc | 88.30 | 25.0 | 0.050 | 87.2 | 7.4 |
| | Head (calc) | 100.00 | 25.3 | 0.60 | 100.0 | 100.0 |
| Norit-RO 0.8 | Mo 3rd Cl conc | 1.33 | 5.52 | 31.3 | 0.3 | 67.5 |
| | Mo Ro conc | 10.80 | 26.4 | 5.35 | 11.2 | 93.7 |
| | Cu conc | 89.20 | 25.4 | 0.043 | 88.8 | 6.3 |
| | Head (calc) | 100.00 | 25.5 | 0.61 | 100.0 | 100.0 |
| Sethco-powdered | Mo 3rd Cl conc | 4.30 | 23.1 | 9.92 | 3.9 | 76.9 |
| | Mo Ro conc | 18.00 | 29.8 | 2.85 | 21.0 | 92.3 |
| | Cu conc | 82.00 | 24.5 | 0.052 | 79.0 | 7.7 |
| | Head (calc) | 100.00 | 25.4 | 0.56 | 100.0 | 100.0 |

Reference was made hereinbefore to U.S. Pat. No. 2,559,104 to Arbiter et al which teaches the oxidizing of a collector prior to the subsequent separation stages, and the use of activated carbon to reduce excess frother and excess collector in the subsequent cleaning stages. While apparently similar to the process of the present invention, the chemical route taught by Arbiter et al is, in fact, exactly opposite to that employed in the process of the present invention. Thus while Arbiter et al teaches the use of an oxidizing agent to deactivate the collector, the process of the present invention employes activated carbon to deactivate the collector, and there is strong evidence that in so doing, the activated carbon acts as a reducing agent.

Measurements were made of the oxidation-reduction potential (emf) of the pulp just prior to molybdenum rougher flotation. These measurements were made at various levels of activated carbon and the results are set forth in Table 11.

TABLE 11

| Pounds Activated Carbon Per Ton Ore | Pulp emf, −mv |
|---|---|
| 0.00 | 380 |
| 0.075 | 360 |
| 1.15 | 300 |
| 0.30 | 260 |
| 0.60 | 190 |
| 0.90 | 180 |

TABLE 11-continued

| Pounds Activated Carbon Per Ton Ore | Pulp emf, −mv |
|---|---|
| 1.25 | 170 |

In addition, it has been found that sodium zinc cyanide, which was heretofore considered to be an essential reagent to the process, can be omitted. A further series of tests were conducted in which the emf was measured on a series of pulps wherein the sodium zinc cyanide was omitted, the level of activated carbon was maintained constant, and only the conditioning time was varied. The data developed in these further tests are set forth in Table 12, while the distribution of copper and molybdenum is described in Table 13.

TABLE 12

| 0.60 lb Activated Carbon /Ton Ore | Pulp emf, −mv |
|---|---|
| (20 minute A.C. cond time) | 160 |
| (10 minute A.C. cond time) | 190 |
| ( 5 minute A.C. cond time) | 230 |

TABLE 13

| Effect of Elimination of Sodium Zinc Cyanide | | | | | | |
|---|---|---|---|---|---|---|
| | | Weight | Assay, % | | Distribution, % | |
| Condition | Product | % | Cu | Mo | Cu | Mo |
| Standard, with | Mo 3rd Cl conc | 1.77 | 13.7 | 23.5 | 1.0 | 69.8 |
| NaZnCN 0.60 lb A.C. | Mo Ro conc | 10.73 | 26.6 | 4.98 | 11.6 | 89.5 |
| /ton ore to Cond 1 | Cu conc | 89.27 | 24.4 | 0.070 | 88.4 | 10.5 |
| | Head (calc) | 100.00 | 24.6 | 0.60 | 100.0 | 100.0 |
| 0.60 lb A.C./ton ore | Mo 3rd Cl conc | 1.13 | 12.7 | 29.7 | 0.6 | 65.8 |
| No NaZnCn | Mo Ro conc | 9.03 | 29.7 | 5.10 | 10.4 | 90.2 |
| | Cu conc | 90.97 | 25.3 | 0.055 | 89.6 | 9.8 |
| | Head (calc) | 100.00 | 25.7 | 0.51 | 100.0 | 100.0 |
| No activated carbon | Mo Ro Conc | 45.97 | 30.2 | 1.38 | 54.3 | 96.4 |
| No NaZnCN | Cu conc | 54.03 | 21.6 | 0.044 | 45.7 | 3.6 |
| | Head (calc) | 100.00 | 25.6 | 0.66 | 100.0 | 100.0 |

The data in Tables 11 and 12 clearly indicate that as the level of activated carbon increased, and/or as the conditioning time increased for a fixed level of carbon, the emf of the pulp decreased. In other words, the net effect of the treatment with activated carbon was to achieve a reduction reaction as evidenced by these substantially lower emf measurements.

Though not willing to be bound by any one theory by which the functioning of the activated carbon might be explained, at least one possible mechanism is that the activated carbon functions by desorption of oxygen from the collector-mineral surface bond to render a given sulfide mineral hydrophillic. Desorption of the oxygen from the sulfide minerals surface would render collector inactive, and therefore, the mineral particle hydrophillic. In a copper molybdenum separation, the action of the activated carbon is apparently specific to copper and iron sulfide minerals rendering these less floatable than the molybdenite, while it very surprisingly does not appear to cause desorption of oxygen and/or collector from the molybdenite surface and the molybdenite, therefore, continues to be hydrophobic.

It will, of course, be obvious to those skilled in the art, that many changes and substitutions can be made in the specific materials, reactants, and procedural steps set forth hereinbefore, without departing from the scope of the present invention, and it is my intention to be limited only by the appended claims.

What is claimed:

1. In the method for recovery of metal values by froth flotation from metallic sulfide mineral ores comprising copper and molybdenum, including the steps of:
   (A) forming an aqueous mineral pulp from the ore;
   (B) subjecting the pulp to rougher flotation to provide a scavenger feed and a rougher concentrate;
   (C) adding an effective amount of an alkyl mercaptan of the formula $C_nH_{2n+1}SH$ in which n is at least 12 to the rougher flotation stage (B) or to the scavenger feed resulting therefrom, as a collector, and subjecting the scavenger feed to flotation to provide a scavenger tailing and a scavenger concentrate;
   (D) combining, regrinding, and cleaning the concentrates from the rougher and scavenger flotation states (B) and (C) to provide a copper-molybdenum cleaner concentrate; and then
   (E) subjecting the cleaner concentrate of step (D) to component mineral stage flotation separation; the improvement which comprises deactivating a substantial amount of the mercaptan collector on the mineral of the ore in the cleaner concentrate of step (D) prior to the component mineral stage flotation separation in step (E), said deactivating comprising adding a deactivating effective amount of activated carbon to the cleaner concentrate prior to flotation in step (E); to provide more effective mineral separation of said copper and molybdenum.

2. The method as defined in claim 1, wherein the amount of activated carbon is within the range of about 0.25 to about 1.0 pound of activated carbon per ton of initial ore feed.

3. The method as defined in claim 1, wherein the activated carbon is added to the cleaner concentrate a sufficient time prior to step (E) to provide substantial deactivation of the mercaptan prior to commencement of the step (E) separation stage.

4. The method as defined in claim 3, wherein the time prior to step (E) separation stage is within the range of about 5 minutes to about 30 minutes.

5. The method as defined in claim 1, wherein the mercaptan is normal dodecyl mercaptan.

6. The method as defined in claim 5, wherein said mercaptan is added in an amount within the range of about 0.005 to about 0.02 pounds per ton of ore.

7. The method as defined in claim 6, wherein the amount of activated carbon added is within the range of about 0.25 to about 1.0 pound per ton of initial ore feed.

* * * * *

UNITED STATES PATENT AND TRADEMARK OFFICE

CERTIFICATE OF CORRECTION

PATENT NO. : 4,268,380

DATED : May 19, 1981

INVENTOR(S) : DOULGAS R. SHAW

It is certified that error appears in the above—identified patent and that said Letters Patent is hereby corrected as shown below:

IN THE DRAWINGS

Figure 2:
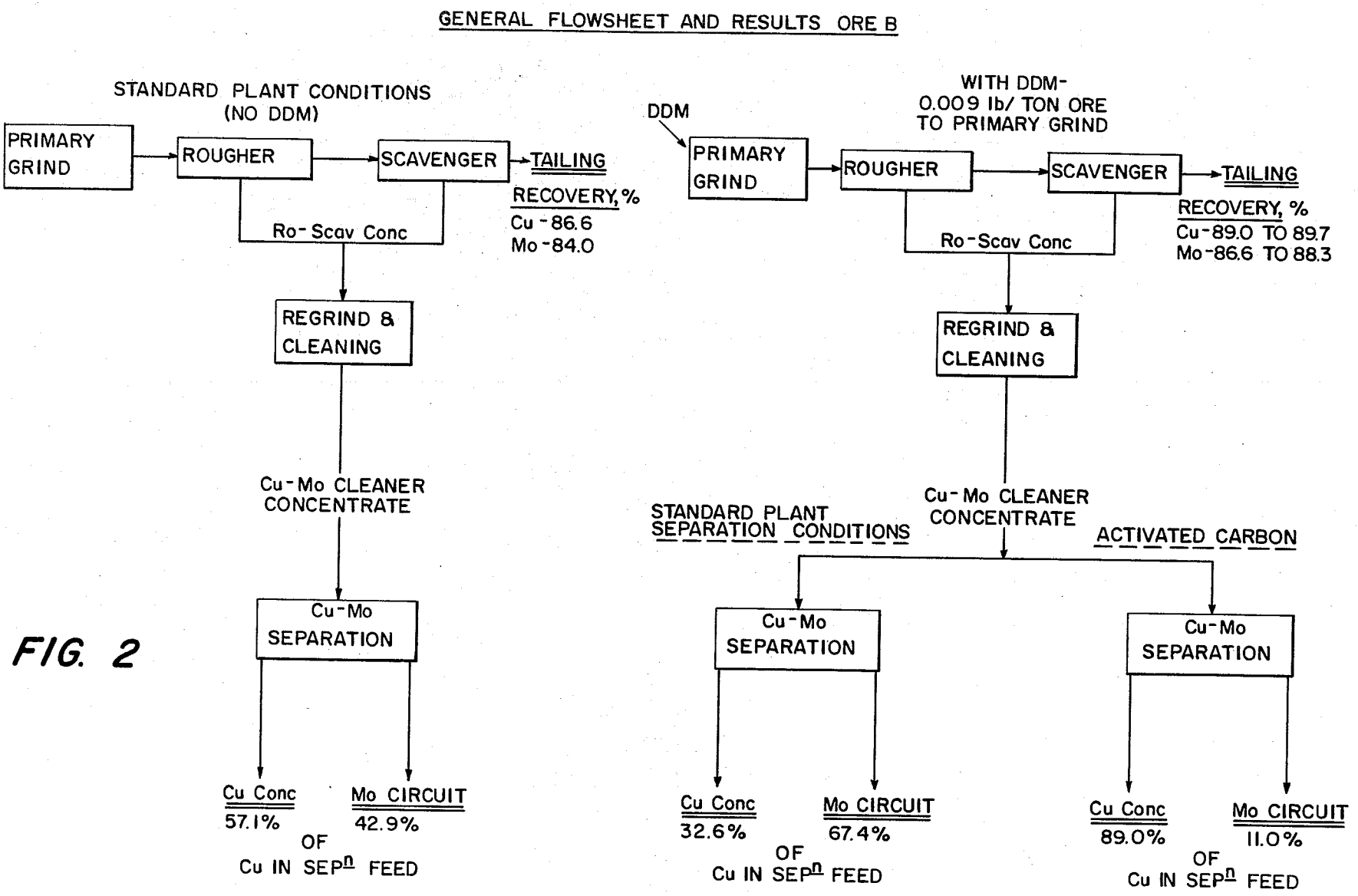

At each location at the bottom of Fig. 1 and Fig. 2 (a total of six places), change "Mo CIRCUIT" to read --Mo Ro Conc--.

Signed and Sealed this

*Fourth* Day of *August 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,268,380

DATED : May 19, 1981

INVENTOR(S) : DOUGLAS R. SHAW

It is certified that error appears in the above—identified patent and that said Letters Patent is hereby corrected as shown below:

Column 1, line 47, delete "further" and insert --frother--.

Column 2, line 17, delete "removed" and insert --improved--;

line 43, delete "and" and insert --an--;

line 44, correct the formula to read --$C_nH_{2n+1}SH$--.

Column 3, line 2, after "to" insert --about--.

Column 12, claim 1, line 19, "states" should read --stages--.

Signed and Sealed this

First Day of September 1981

[SEAL]

Attest:

GERALD J. MOSSINGHOFF

Attesting Officer

Commissioner of Patents and Trademarks